US005800323A

United States Patent [19]

Ansel

[11] Patent Number: 5,800,323

[45] Date of Patent: Sep. 1, 1998

[54] ADJUSTABLE HIP AND THIGH EXECISER

[76] Inventor: Cliff Ansel, 252 York Hill Boulevard, Thornhill, Ontario, Canada, L4J 2P6

[21] Appl. No.: 888,770

[22] Filed: Jul. 7, 1997

[51] Int. Cl.[6] ..... A63B 21/02

[52] U.S. Cl. ..... 482/129; 482/904; 482/137

[58] Field of Search ..... 482/123, 129, 482/904, 137

[56] References Cited

U.S. PATENT DOCUMENTS

| | | | |
|---|---|---|---|
| 2,777,439 | 1/1957 | Tuttle . | |
| 4,666,149 | 5/1987 | Olschansky et al. . | |
| 5,039,092 | 8/1991 | Olschansky et al. . | |
| 5,062,633 | 11/1991 | Engel . | |
| 5,277,684 | 1/1994 | Harris | 482/123 |
| 5,407,414 | 4/1995 | Bass | 482/904 |
| 5,456,644 | 10/1995 | Hecox et al. . | |

*Primary Examiner*—Lynne A. Reichard
*Attorney, Agent, or Firm*—Buchanan Ingersoll, P.C

[57] ABSTRACT

An adjustable hip and thigh exercise apparatus which is releasably attached to the end of a wall including a frame, a clamp, a lever pivotably attached to the frame, a lock to allow the lever to have a number of initial positions, a lengthening assembly to allow the lever arm to be lengthened or shortened, and a variable resistance element. The apparatus is attached to the wall and aligned with the pivot point of the user's hip. The user sets the desired resistance of the exercise machine and bends his or her leg over the lever and causes the lever to rotate from the initial position to a second position thereby exercising the muscles of the leg. The user can also adjust the range of motion desired to exercise the leg muscles as well as the resistance against which the leg muscles will exercise.

22 Claims, 6 Drawing Sheets

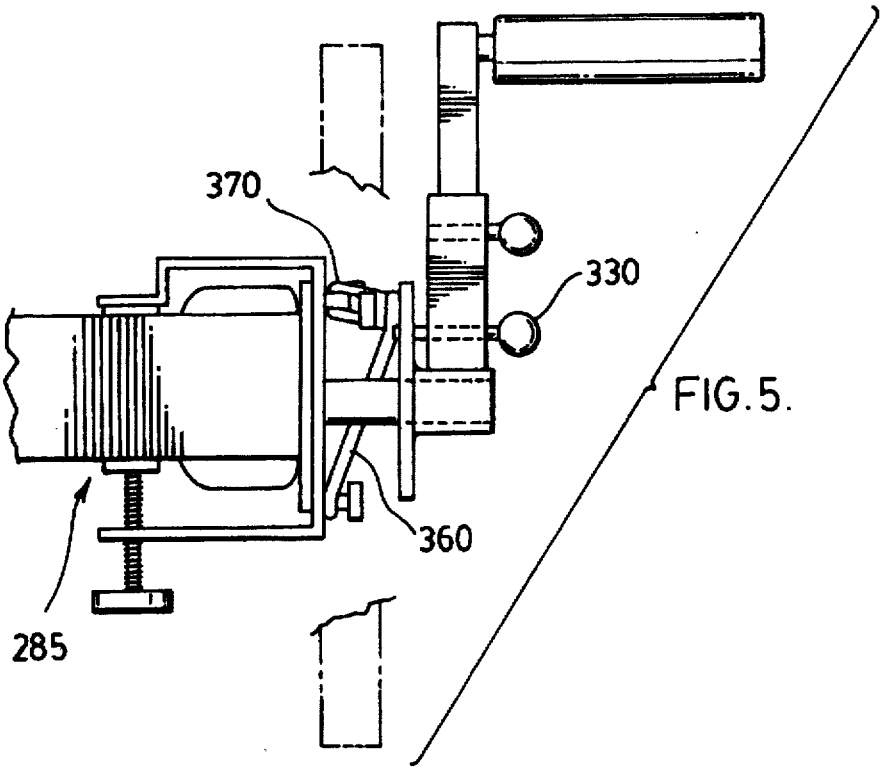
FIG. 5.
FIG. 6.
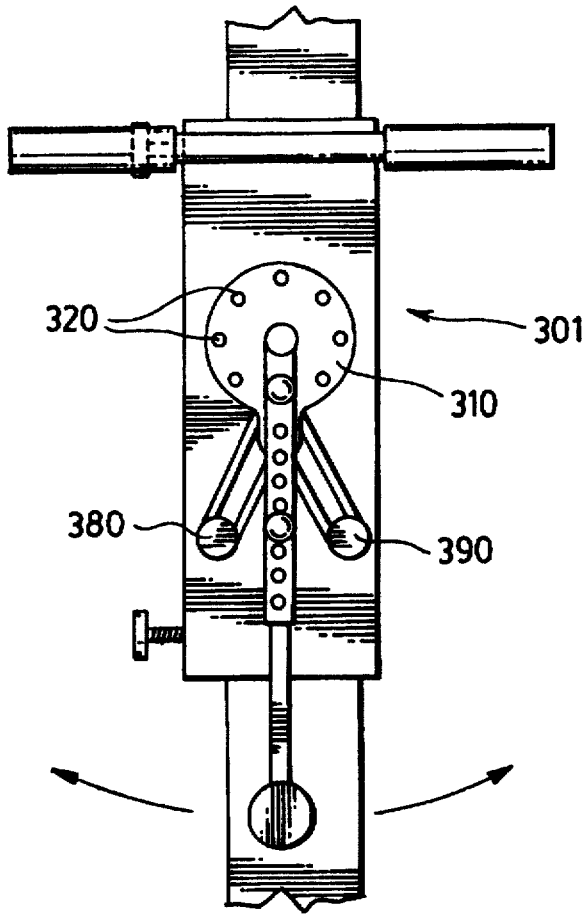

ADJUSTABLE HIP AND THIGH EXECISER

FIELD OF THE INVENTION

This invention relates generally to the field of home exercise apparatus, and in particular, to compact exercise machines which are used to exercise the muscles of the lower body and, in particular, the hip and thigh muscles.

BACKGROUND OF THE INVENTION

Home exercise apparatus are known in the art as they offer the advantages of convenience and privacy over the large and expensive apparatus used in health clubs.

This invention relates specifically to the strengthening or rehabilitating of the hip and thigh muscles. Hip and thigh injuries can be extremely debilitating and these injuries typically require surgery and long recovery times. There is therefore a need for a device to strengthen the hip and thigh muscles and to assist in the recovery from injuries to these muscles.

Many devices in the prior art have combined in one apparatus the ability to strengthen several different muscle groups, including upper and lower body muscles. However, the lower body muscles which are strengthened in these devices are usually the quadricep or calf muscles of the leg. Further, these devices suffer from the drawback of being large and cumbersome and not easily stored. As well, many of these devices do not allow the easy alignment of the device to the rotation point of the hip or the adjustment to suit different lengths of user's legs. Examples of these multi-muscle group type of apparatus is shown in U.S. Pat. No. 5,456,644 to Hecox et al and in U.S. Pat. Nos. 4,666,149 and 5,039,092 to Olschansky et al.

Some multi-exercise type devices have been designed to strengthen, among other muscles, the hip muscles. An example of such a device is shown in U.S. Pat. No. 2,777,439 to Tuttle. This type of device is again large and cumbersome and not easily stored. This device also suffers from the drawback of having casters under a supporting platform which makes the device unstable and unsuitable for the large torque forces generated when exercising the gluteal muscles, adductors and hip flexors. A second example of such a device is shown in U.S. Pat. No. 5,062,633 to Engel. This device is again unstable as the user must place his or her full weight on the frame in order to prevent the device from moving during exercise.

Therefore, in order to strengthen the hip and thigh muscles and to help in the recovery from injuries to these areas, it would be desirable to have a portable, easily stored and adjustable apparatus which is stable under the large torque forces applied by these muscle groups during exercise.

SUMMARY OF THE PRESENT INVENTION

According to one aspect of the present invention, there is provided an adjustable hip and thigh exercise apparatus comprising:

a) a frame;

b) a clamp on the frame adapted to releasably attach the apparatus to one end of a wall so as to align the apparatus with a user's hip joint;

c) a lever pivotably attached to the frame and adapted to rotate from a first position to a second position through an axis of rotation generally parallel to the wall; and d) a means for providing resistance to the rotation of the lever, whereby the apparatus is clamped to the end of a wall and aligned with the user's hip joint and a force is applied by the user's hip and thigh muscles to rotate the lever from the first position to the second position.

According to a second aspect of the present invention, there is provided an adjustable hip and thigh exercise apparatus comprising:

a) a frame;

b) a clamp on the frame adapted to releasably attach the apparatus to an end of a wall so as to align the apparatus with a user's hip joint;

c) a lever pivotably attached to the frame and adapted to rotate from a first position to a second position through an axis of rotation generally parallel to the wall;

d) a means for changing the first position of the lever;

e) an assembly allowing the user to lengthen or shorten the lever;

f) a means for providing resistance against the rotation of the lever; and g) handles to provide support to the user, whereby the apparatus is clamped to the end of a wall and aligned with the user's hip joint and a force is applied by the user's hip and thigh muscles to rotate the lever from the first position to the second position.

BRIEF DESCRIPTION OF THE DRAWINGS

Reference will now be made, by way of example only, to preferred embodiments of the invention with reference to the following drawings in which:

FIG. 5 is a top plan view of the embodiment of FIG. 2;

FIG. 6 is a front view of the embodiment of FIG. 2 showing the exerciser attached to a wall;

DETAILED DESCRIPTION OF THE INVENTION

Figure 1:
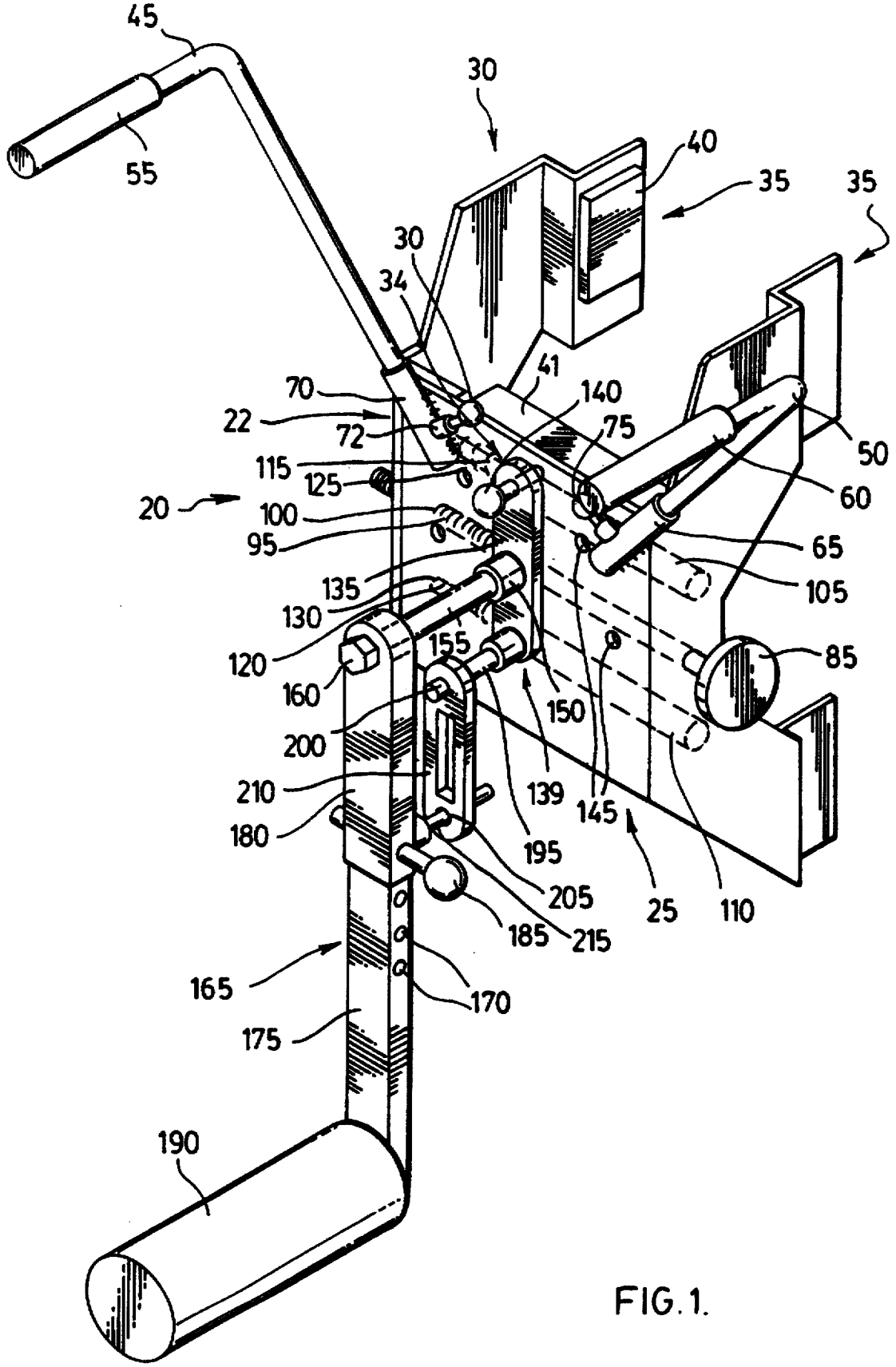
FIG. 1 is a perspective view showing a first embodiment of the adjustable hip and thigh exerciser of the present invention.
Figure 2:
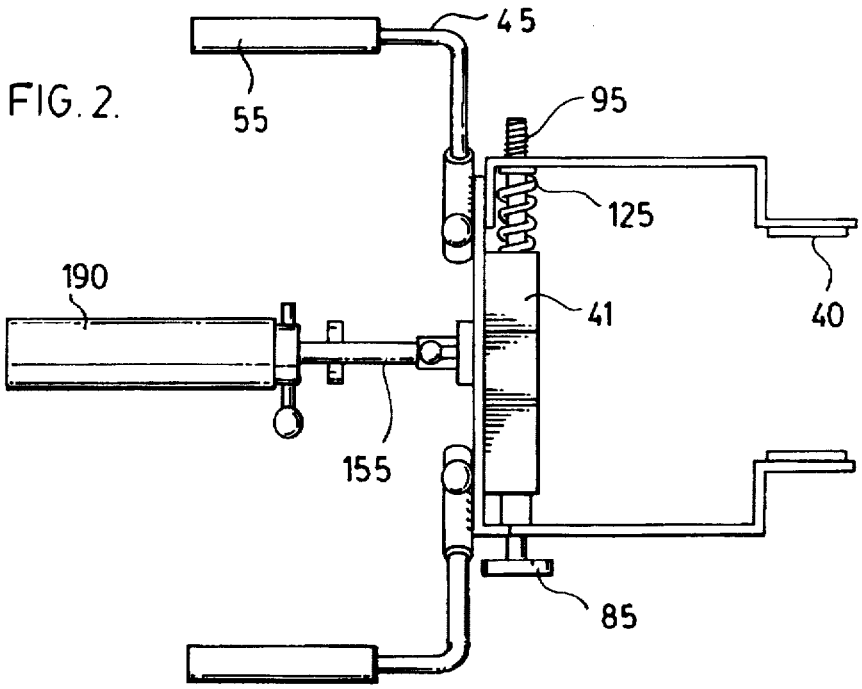
FIG. 2 is a top plan view of the embodiment of FIG. 1.
Figure 3:
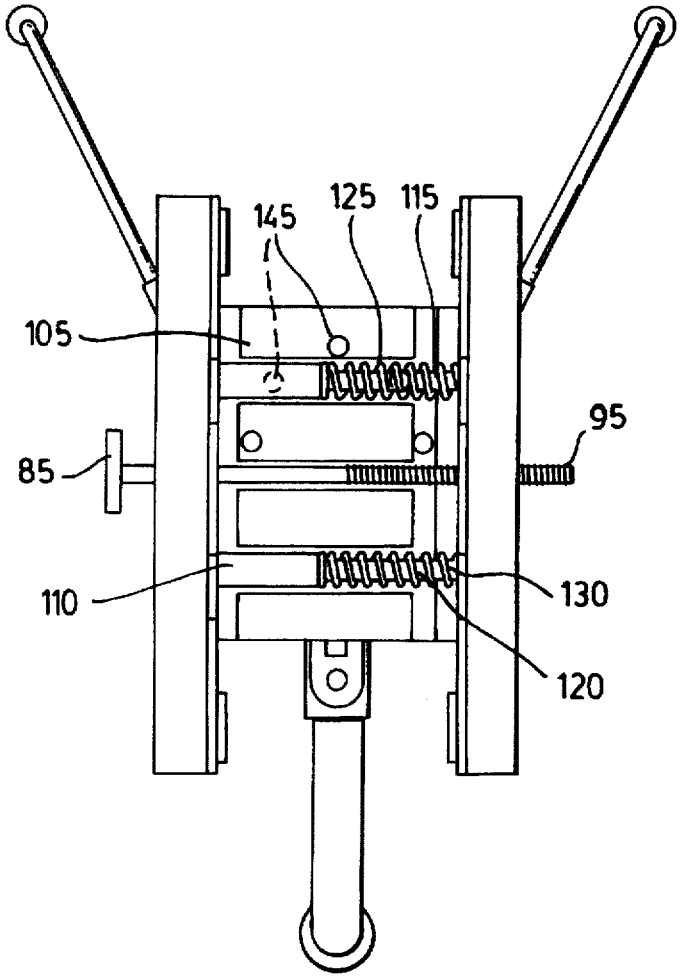
FIG. 3 is a view from the end of the exerciser of the embodiment of FIG. 1 which attaches to a wall.

Attention is first directed to FIG. 1, in which numeral 20 generally denotes one embodiment of the hip and thigh apparatus of the present invention. The apparatus 20 comprises a frame 22 and a clamp generally denoted as numeral 35 which attaches the apparatus 20 to the end of, for example to a wall adjacent a doorway. The apparatus 20 can be attached to a wall at a desired height so as to properly align the apparatus with a user's hip. The user exercises the hip and thigh muscles while remaining in a standing position and while using handles 45, 50 to support himself. Various muscles of the hip and thigh can be exercised as illustrated in FIGS. 8 to 12.

The user can adjustably secure the apparatus 20 to the end of a wall by tightening the clamp 35. The clamp 35 include first securing rod 115 and second securing rod 120 and a threaded rod 95 which when tightened compress a large frame element 25 and a small frame element 30. The small frame element 30 has a threaded hole 100 as illustrated in FIG. 1 which is cooperatively engaged by threaded rod 95. Knob 85 helps the user tighten the threaded rod 95 to secure the apparatus to the end of a wall. The frame 22 and clamp 35 can be made of any suitable material such as plastic, wood or metal.

The first securing rod 115 is attached to the small frame element 30. Cylindrical housing 105 is attached to the large frame element 25. First securing rod 115 slidably engages cylindrical housing 105 when the clamp 35 is tightened. This stabilizes the apparatus. A first spring 125 surrounds first securing rod 115. The diameter of the first spring 125 is generally larger than that of the first securing rod 115, and less than that of the cylindrical housing 105. The first spring 125 is compressed against the cylindrical housing 105 when the threaded rod 95 is tightened. The first spring 125 provides a force to help open the clamp 35 when threaded rod 95 is loosened.

Second securing rod 120, second cylindrical housing 110 and second spring 130 interact in the same manner.

Handle housing 70, attached to the large frame element 25, cooperatively receives a L-shaped handle 45 as illustrated in FIG. 1. The handle supports the user while exercising. Handle housing 70 includes a cylindrical receiving means 72 through which a handle pin 80 can pass and engage an aperture defined in L-shaped handle housing 45 to secure the handle 45 to the large frame element 25. Sleeve 55, made of rubber or some other material, covers the distal portion of L-shaped handle 45 so as to protect the user's hands while exercising. L-shaped handle 50, handle housing 65, sleeve 60, handle pin 75 and the various apertures defined by these structures interact in a same fashion. The handles 45, 50 are easily removed for storage.

Styrofoam pads 40 and 41 or pads of some other material are attached to the faces of the clamp 35 and to the frame 22 in order to protect and prevent the wall from being damaged when the apparatus is attached to the wall.

A rotatable plate means 135 is pivotably attached to the large frame element 25. The rotatable plate means 135 has an upper end 137 and a lower end 139.

The lever means 165 is able to lengthen or shorten to fit the user. The lever means 165 comprises a tubular member 180 and an L-shaped member 175. Tubular member 180 is slidable onto L-shaped member 175 to allow the lever means 165 to be adjustable in length. It is generally desired to have the L-shaped portion of the lever means covered by a styrofoam pad 190 which engages the user's thigh just above the knee, as illustrated in FIGS. 8 to 12. The tubular member 180 is attached to the rotatable plate means 135 via a central shaft 155 and locked into place by nut 160. The rotatable plate means 135 additionally comprises a central shaft housing 150 designed to receive the central shaft 155.

The L-shaped member 175 includes a plurality of spaced apart openings 170. Locking pin 185 is insertable through tubular member 180 and alignable with spaced apart openings 170 defined by the L-shaped member 175 to allow adjustment of the length of the lever means 165.

A first connecting rod 195 is attached to the rotatable plate means 135 and a second connecting rod 215 is attached to the tubular member. The first and second connecting rods 195, 215 releasably engage apertures defined at either end of a generally elliptical resistance element 210. Bushings 200, 205 are placed over the first and second connecting rods 195, 215 and the resistance element 210 lies on these bushings 200, 205 so as to minimize wear points and to evenly distribute the forces on the resistance element 210. It will readily be understood that by increasing the number of elliptical resistance elements the resistance experienced by the user while exercising will also increase.

The large frame element 25 further comprises a plurality of spaced apart frame apertures 145, each frame aperture 145 being equidistant from the central shaft housing 150. The rotatable plate contains a lock pin 140 which is insertable through the rotatable plate means 135 and capable of being aligned with the frame apertures 145 in order to vary the initial exercise position of the lever means 165. Lever means 165 can be placed in various start positions in order to increase or decrease the difficulty level of the user's exercise program or for different exercises. A lever means 165 is attached to the rotatable plate means 135.

The lever means 165 is adapted to rotate from an initial first position to a second position through a generally upright axis of rotation generally parallel to the wall to which the apparatus is attached. The user can exercise different muscles of the hip and thigh depending on the initial position of the lever means and where the horizontal portion of the L-shaped member 175 is placed relative to the leg. It can readily be understood that the user can exercise the adductor, abductor, gluteal and hip flexor muscles of the body depending on the initial positioning of the L-shaped member 175. Various exercise positions for the user are illustrated in FIGS. 8 to 11.

Figure 4:
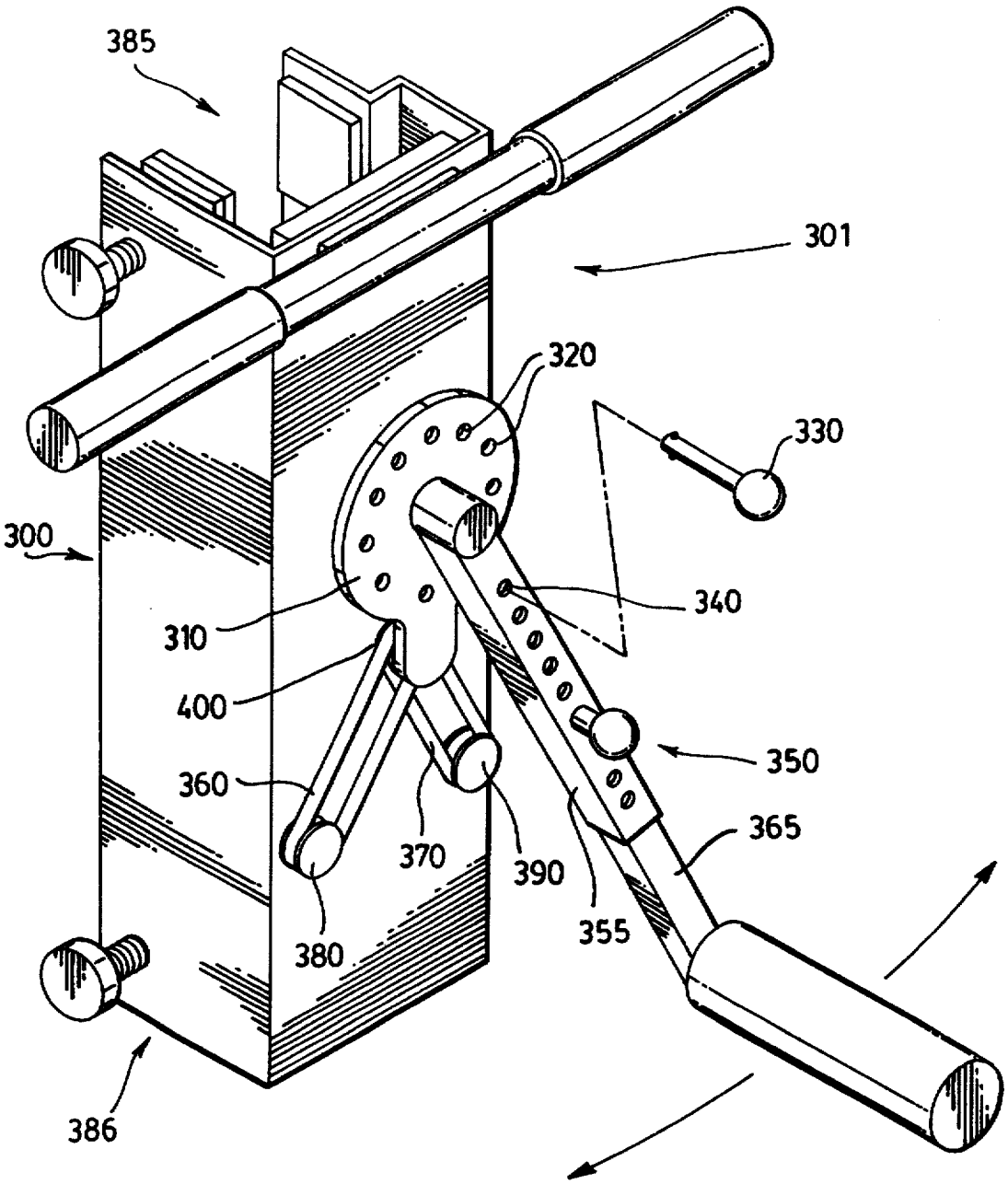
FIG. 4 is a perspective view showing a second embodiment of the present invention.

A second embodiment of the hip and thigh apparatus 301 of the present invention is illustrated in FIG. 4. Pivotably attached to a frame 300 is rotatable plate 310 having a plurality of spaced apart apertures 320 arranged in a substantially circular configuration. A lever means 350 is attached to the rotatable plate 310. The lever means 350 comprises a tubular member 355 which is capable of engaging a L-shaped member 365 as in the first embodiment. The tubular member 355 contains an aperture 340 through which a lock pin 330 can be inserted so as to engage the spaced apart apertures 320 in order to vary the initial exercise position of the lever means 350.

When the apparatus 301 is used, rotational forces around an axis generally parallel to the wall are generated. These forces also act on the apparatus 301 itself and if not properly secured to the wall, will cause the apparatus to dislodge from the wall. The use of a v-shaped clamp 35 as illustrated in FIG. 1 or a clamping means 385, 386 as illustrated in FIG. 4 increases the stability of the apparatus 301.

Figure 7:
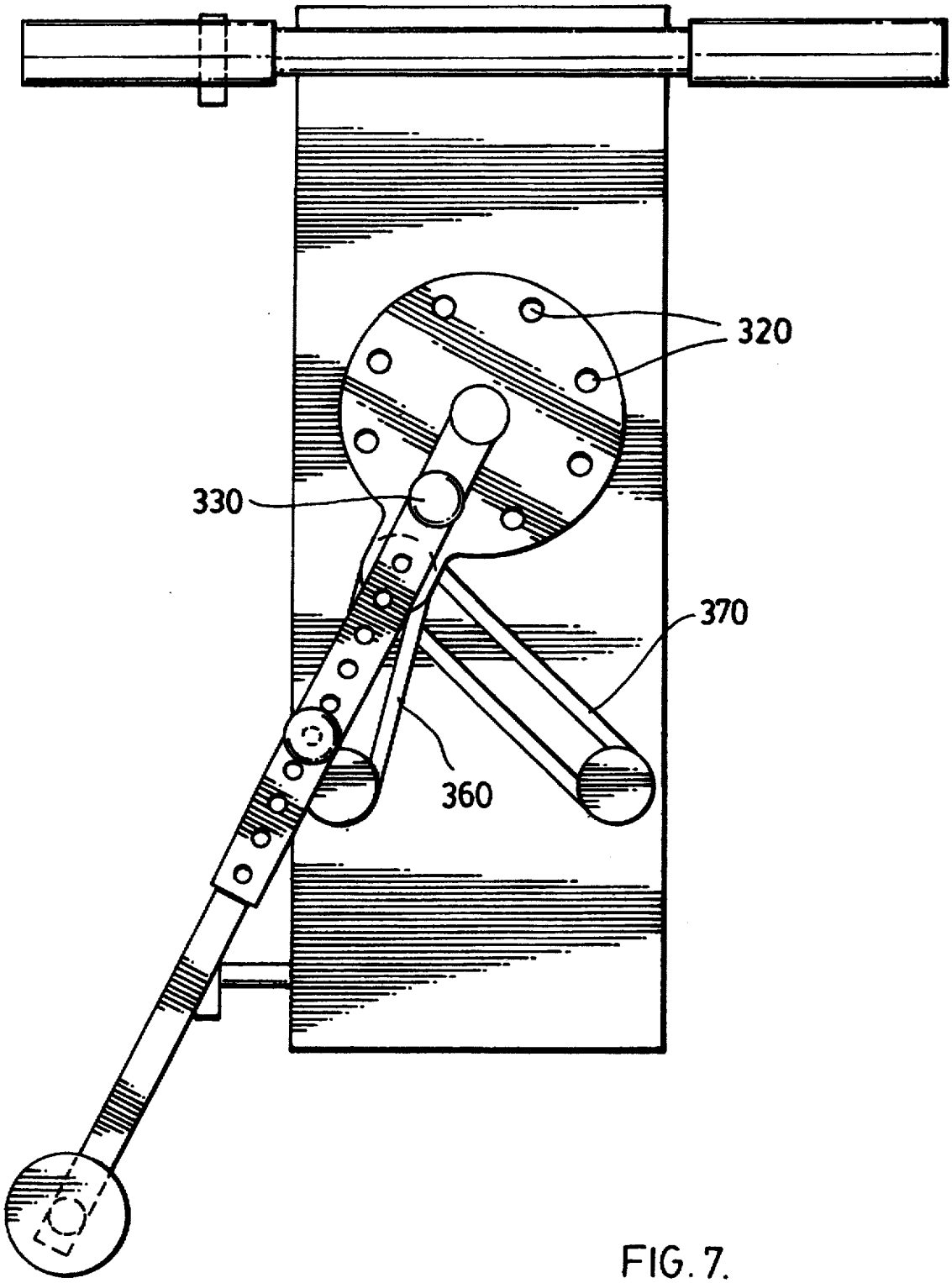
FIG. 7 is a front view of the embodiment of FIG. 2 showing the lever displaced.
Figure 8:
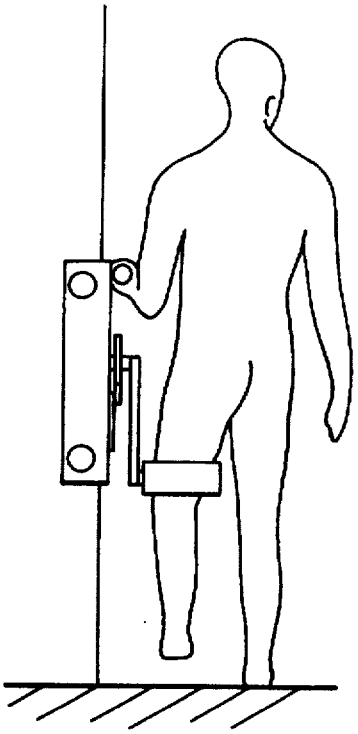
FIGS. 8 to 11 are illustrations of the embodiment of FIG. 2 being used to exercise different muscles.
Figure 9:
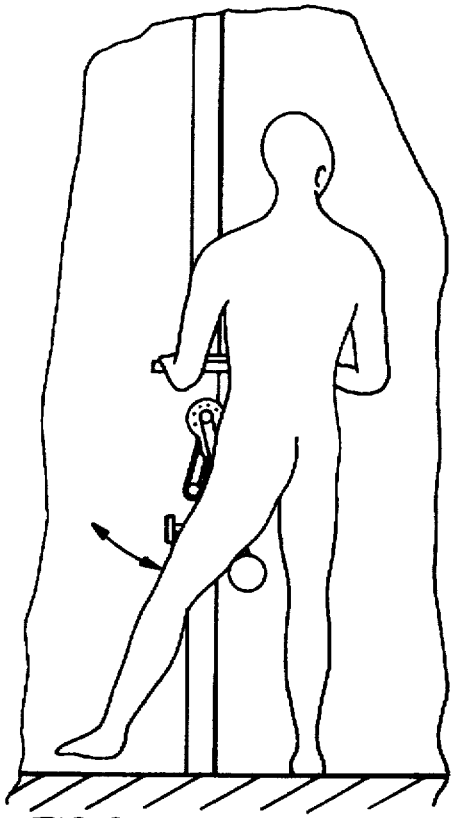
Figure 10:
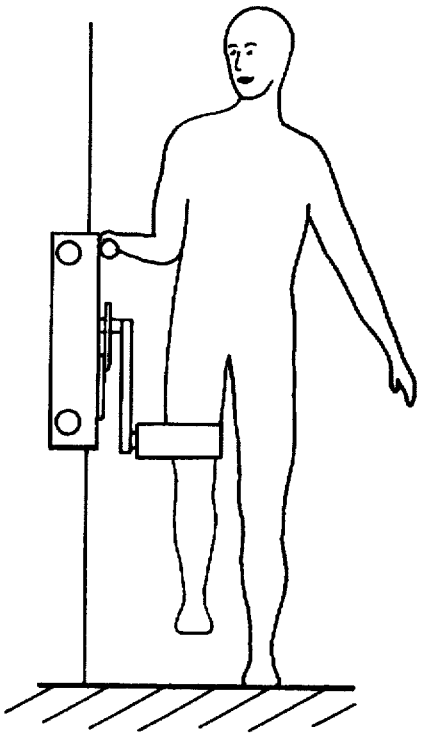
Figure 11:
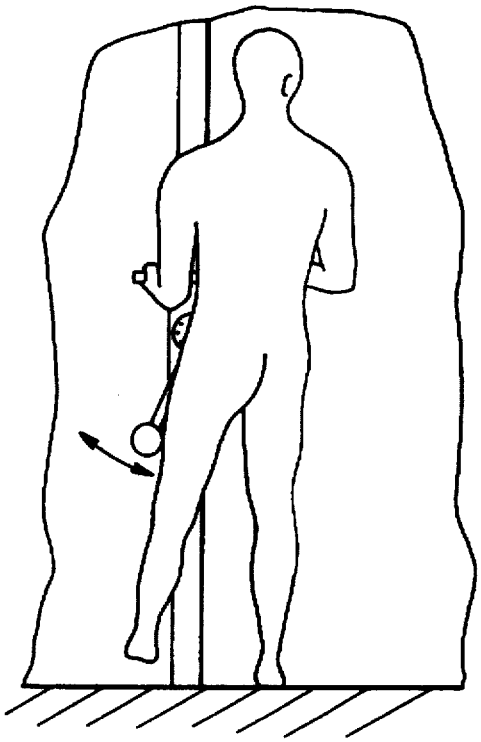

The frame 300 additionally comprises first and second frame knobs 380, 390 attached to the frame 300. The rotatable plate 310 additionally comprises a knob 400 which is capable of engaging elastic cord members 360, 370 stretched between knob 400 and the first and second frame knobs 380, 390 as illustrated in FIG. 4. These elastic cord members 360, 370 provide resistance when the lever means 350 is rotated by the user so as to exercise the hip and thigh muscles as shown in FIGS. 5 and 7. It will be readily understood that resistance can be increased by substituting elastic cords of different thickness.

Other variations and modifications of the invention are possible. For example, a resistance mechanism using torsion springs instead of elastic elements is one such variation. Another variation is the use of different types of clamps in the apparatus to engage the wall. All such modifications or variations are believed to be within the sphere and scope of the invention as defined by the claims appended hereto.

The embodiments of the invention in which an exclusive property or privilege is claimed is defined as follows:

1. An adjustable hip and thigh exercise apparatus comprising:

a) a frame;

b) a clamp on the frame adapted to releasably attach the apparatus to one end of a wall so as to align the apparatus with the user's hip joint;

c) a lever pivotably attached to the frame and adapted to rotate from a first position to a second position to a second position through an axis of rotation generally parallel to the wall;

d) a means for providing resistance to the rotation of the lever, whereby the apparatus is clamped to the end of a wall and aligned with the user's hip joint and a force is applied by the user's hip and thigh muscles to rotate the lever from the first position to the second position;

e) a rotatable plate on the frame, the rotatable plate having upper and lower ends, the lever is attached between the upper and lower ends of the rotatable plate, whereby the lever rotates from the first position to the second position; and f) a resistance element having a first end attached to the rotatable plate and a second end attached to the lever, whereby the resistance element provides resistance when the lever rotates from the first position to the second position.

2. The apparatus as claimed in claim 1 wherein the lever comprises a L-shaped member having a plurality of spaced apart openings; a tubular member slidable onto the L-shaped member; the tubular member having an aperture through which a locking pin can engage any one of the openings of the L-shaped member whereby the lever can be lengthened or shortened in order to fit the user's leg.

3. The apparatus as claimed in claim 2 additionally comprising at least one handle on the frame to provide support to the user during use of the apparatus.

4. The apparatus as claimed in claim 1 additionally comprising means for changing the first position of a lever.

5. The apparatus as claimed in claim 4 additionally comprising a plurality of spaced apart apertures on the frame and the rotatable plate having a further aperture through which a locking pin engages any of the spaced apart apertures on the frame so as to change the first position.

6. The apparatus as claimed in claim 5 wherein the lever comprises a L-shaped member having a plurality of spaced apart openings; a tubular member slidable onto the L-shaped member; the tubular member having an aperture through which a locking pin can engage any one of the openings of the L-shaped member whereby the lever can be lengthened or shortened in order to fit the user's leg.

7. The apparatus as claimed in claim 6 additionally comprising at least one handle on the frame to provide support to the user during use of the apparatus.

8. The apparatus as claimed in claim 1 wherein the rotatable plate is generally circular.

9. The apparatus as claimed in claim 8 further comprising one or more elastic cord between the frame and the rotatable plate whereby the elastic cord provides resistance when the lever is moved from the first position to the second position.

10. The apparatus as claimed in claim 9 additionally comprising means for changing the first position of the lever.

11. The apparatus as claimed in claim 10 additionally comprising a plurality of spaced apart apertures on the frame and the rotatable plate having a further aperture through which a locking pin engages any of the spaced apart apertures on the frame so as to change the first position.

12. The apparatus as claimed in claim 11 wherein the lever comprises a L-shaped member having a plurality of spaced apart openings; a tubular member slidable onto the L-shaped member; the tubular member having an aperture through which a locking pin can engage any one of the openings of the L-shaped member whereby the lever can be lengthened or shortened in order to fit the user's leg.

13. The apparatus as claimed in claim 12 additionally comprising at least one handle on the frame to provide support to the user during use of the apparatus.

14. An adjustable hip and thigh exercise apparatus comprising:

a) a frame;

b) a clamp on the frame adapted to releasably attach the apparatus to an end of a wall so as to align the apparatus with a user's hip joint;

c) a lever pivotably attached to the frame and adapted to rotate from a first position to a second position through an axis of rotation generally parallel to the wall;

d) a means for changing the first position of the lever;

e) an assembly allowing the user to lengthen or shorten the lever;

f) a means for providing resistance against the rotation of the lever;

g) handles to provide support to the user;

whereby the apparatus is clamped to the end of a wall and aligned with the user's hip joint and a force is applied by the user's hip and thigh muscles to rotate the lever from the first position to the second position;

h) a rotatable plate on the frame, the rotatable plate having upper and lower ends, the lever is attached between the upper and lower ends of the rotatable plate, whereby the lever rotates from the first position to the second position; and i) a resistance element having a first end attached to the rotatable plate and a second end attached to the lever, whereby the resistance element provides resistance when the lever rotates from the first position to the second position.

15. The apparatus as claimed in claim 14 additionally comprising a plurality of spaced apart apertures on the frame and the rotatable plate having a further aperture through which a locking pin engages any of the spaced apart apertures on the frame so as to change the first position.

16. The apparatus as claimed in claim 15 wherein the lever comprises a L-shaped member having a plurality of spaced apart openings; a tubular member slidable onto the L-shaped member; the tubular member having an aperture through which a locking pin can engage any one of the openings of the L-shaped member whereby the lever can be lengthened or shortened in order to fit the user's leg.

17. The apparatus as claimed in claim 16 additionally comprising at least one handle on the frame to provide support to the user during use of the apparatus.

18. The apparatus as claimed in claim 14 wherein the rotatable plate is generally circular.

19. The apparatus as claimed in claim 18 further comprising an elastic cord between the frame and the rotatable plate whereby the elastic cord provides resistance when the lever is moved from the first position to the second position.

20. The apparatus as claimed in claim 19 additionally comprising a plurality of spaced apart apertures on the frame and the rotatable plate having a further aperture through which a locking pin engages any of the spaced apart apertures on the frame so as to change the first position.

21. The apparatus as claimed in claim 20 wherein the lever comprises a L-shaped member having a plurality of spaced apart openings; a tubular member slidable onto the L-shaped member; the tubular member having an aperture through which a locking pin can engage any one of the openings of the L-shaped member whereby the lever can be lengthened or shortened in order to fit the user's leg.

22. The apparatus as claimed in claim 21 additionally comprising at least one handle on the frame to provide support to the user during use of the apparatus.

* * * * *